United States Patent [19]

Devlin

[11] 3,999,347

[45] Dec. 28, 1976

[54] HANDY HELPER

[75] Inventor: John V. Devlin, Paterson, N.J.

[73] Assignee: Lawrence Peska Associates, Inc., New York, N.Y. ; a part interest

[22] Filed: Jan. 27, 1976

[21] Appl. No.: 652,827

[52] U.S. Cl. ..... 52/514

[51] Int. Cl.[2] ..... E04G 23/02; E04B 1/40

[58] Field of Search ..... 52/127, 514, 27, 698

[56] References Cited

UNITED STATES PATENTS

| | | | |
|---|---|---|---|
| 2,952,099 | 9/1960 | Futterer | 52/27 |
| 2,997,416 | 8/1961 | Helton | 52/514 |
| 3,325,955 | 6/1967 | Haut | 52/514 |
| 3,690,084 | 9/1972 | LeBlanc | 52/514 |

*Primary Examiner*—James L. Ridgill, Jr.
*Attorney, Agent, or Firm*—Eugene V. Mandel

[57] ABSTRACT

A device for repairing a damaged area in wall board or the like such as gypsum lath, sheetrock, or drywall. The device includes a body member cooperating with a stem member which effects repairs by providing a means for the securing of a piece of scrap board behind and adjacent to the damaged area in the wall board for serving as a support when applying patching compounds such as plaster or spackle.

9 Claims, 6 Drawing Figures

HANDY HELPER

BACKGROUND OF THE INVENTION

The present invention relates to devices for repairing holes in walls constructed of wall board and the like and more particularly to a device that provides means for securing a support for filling materials.

In a building having walls constructed of wall board or the like it is frequently necessary to repair punctures and holes knocked therein. Ball, sticks, furniture, and other objects as well as the removal of electrical outlets and sockets commonly cause holes in these types of walls. If a repair is attempted, the patching material falls into the space behind the walls making this a very poor method of repair. Old newspapers, rags, and the like have been used to attempt to provide a suitable backing for patching compounds. All of these methods have proved unsuitable.

The prior art includes several expansion anchoring type devices such as the embodiments disclosed in Standing, U.S. Pat. No. 3,834,107 issued Sept. 10, 1974, LeBlanc, U.S. Pat. No. 3,690,084 issued Sept. 12, 1972, and Haut, U.S. Pat. No. 3,325,955 issued June 20, 1967. These devices must remain inside the wall after patching and therefore cannot be reused. The devices disclosed in Standing, LeBlanc, and Haut are complex in design, they are expensive to manufacture, and are consumed each time a backing is needed. Also, such backing units include one or more elements which have to be positioned against a stud or other suitable means, such as the rear of the adjacent wall, in order to adequately support the unit during and after the damaged area is repaired.

The prior art further includes a wall board repair device as shown in Rosenbloom, U.S. Pat. No. 3,717,970 issued Feb. 27, 1973. The embodiment disclosed therein is a wedge that is inserted into a hole in the wall and is expanded and secured therein. Once again, the device must be expended each time a repair is made making the repair costly. Also the device offers questionable support if the wall board is constructed of a very thin gauge material.

In the U.S. Pat. No. 2,997,416 issued to Helton, Aug. 22, 1961 an apparatus for repairing wall board is disclosed. The apparatus provides means for a wall board patch to be secured in position so that it can be plastered in place. Although simple in design this embodiment is cumbersome to use as it is necessary to rotate the apparatus in order to complete the patching process. Furthermore, the user must provide a nut or stop element that is lost in the wall after patching adding to the expense of the process.

SUMMARY

Therefore, it is a primary object of the present invention to provide a device for repairing a damaged area in wall board or the like, wherein all parts of the device used in effecting a repair may be repeatedly used in making subsequent repairs.

A further object of the present invention is to provide a device for repairing wall board wherein a piece of scrap is secured by the device as a backing for patching compound.

A still further object of the present invention is to provide a device for repairing a damaged area in wall boards or the like that may be used without the support of a stud or adjacent wall.

Another still further object of the present invention is to provide a device for repairing wall board that is easy to use, inexpensive to manufacture, and of durable construction.

These objects, as well as further objects and advantages, of the present invention will become readily apparent after reading the description of a non-limiting illustrative embodiment and the accompanying drawing.

A device for repairing a damaged area in wall board of the like according to the principles of the present invention comprises a body member having a centrally disposed aperture therein, a stem having self-threading means on one end slidably disposed within the aperture, and pressure means adapted to cooperate with the stem and the body member.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
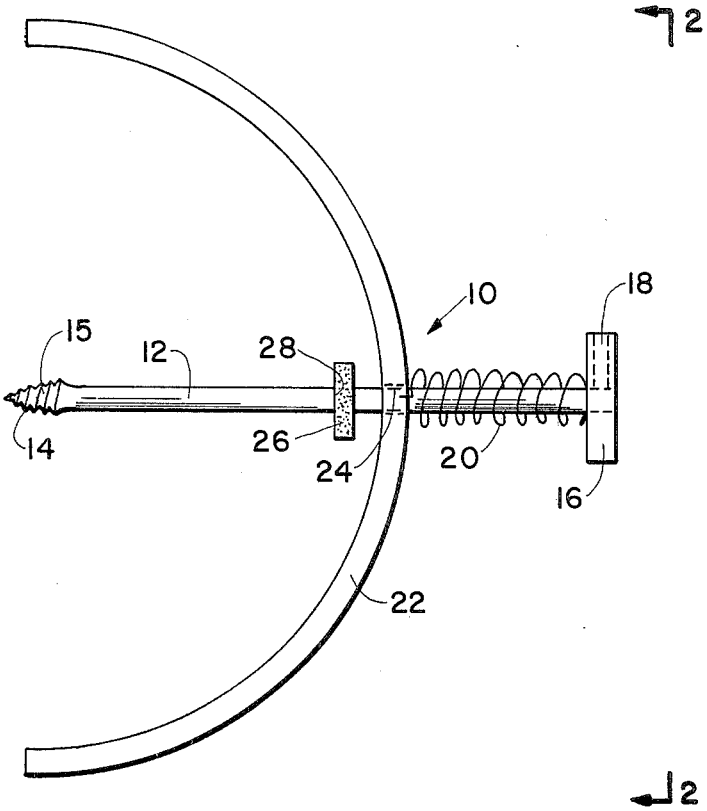
FIG. 1 illustrates a side view of the preferred embodiment of the present invention.
Figure 2:
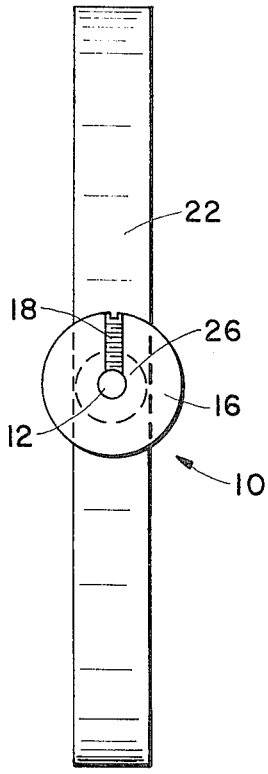
FIG. 2 illustrates a front view of the preferred embodiment of the present invention looking in direction of FIG. 1.

Referring now to the figures, and more particularly to the preferred embodiment of the present invention illustrated with FIGS. 1 and 2 showing a device 10 for repairing a damage area in wall board or the like.

The device 10 includes a stem 12 having an end 14 with conically tapered self-cutting threads 15, a knob 16 disposed on the other end of the stem 12 and secured by a set screw 18, a pressure means in the form of a coil spring 20 disposed around the stem 12 having one end adjacent to the knob 16. Also included is a body member 22 preferably bow-shaped having an aperture 24 centrally disposed therein cooperating with the stem 12 which passes therethrough, and a friction washer 26 having a hole 28 centrally disposed therein cooperating with the stem 12 which passes therethrough. The friction washer 26 is preferably constructed of rubber and serves as a grip for the shaft in addition to the knob 16. The stem 12, the knob 16, and the bow member 22 are preferably constructed of a rigid plastic but may be fabricated from steel or aluminum. The bow member is preferably formed of a material having a flat rectangular shape and is bent into a semicircular or bow shaped form.

Figure 3:
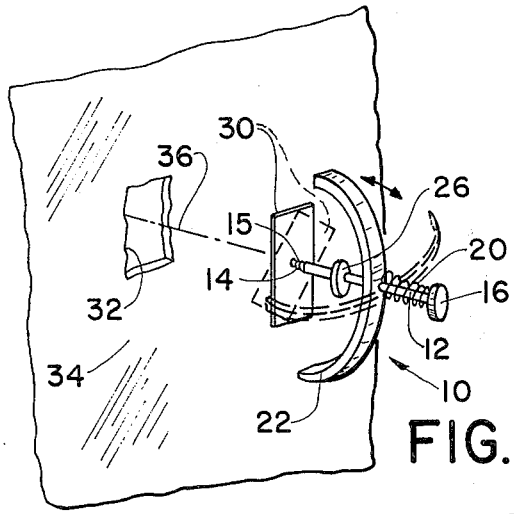
FIG. 3 illustrates a pictorial representation of the preferred embodiment of the present invention ready for securing to a damaged wall.

FIG. 3 is a pictorial representation of the present invention 10 with a piece of scrap board 30 such as wall board, peg board, masonite, or lathing secured on the thread end 14 by being secured thereon. The scrap board 30 is longer but not wider than the hole 32 within the wall 34. The device 10 is moved along the line 36 while it is held at the knob 16 and the friction washer 26 until the scrap board 30 enters the hole 32. The stem 12 is rotated as shown by the arrow 38 until the board 30 is perpendicular to the hole 32.

Figure 4:
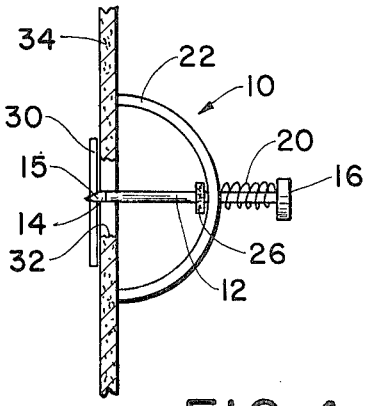
FIG. 4 illustrates a side view of the preferred embodiment of the present invention secured to a partially repaired damage area.

When the user releases the device 10 the spring 20 places pressure on the bow member 22 and the knob 16 causing the board 30 to be drawn tightly against the inside of the wall 34 and the bow member 22 to be drawn tightly against the outside of the wall 34 as shown in FIG. 4. Patching compound 42, which may be plaster, spackle, or the like, is then placed in the hole 32 using the board 30 as a rear support for the same.

Figure 5:
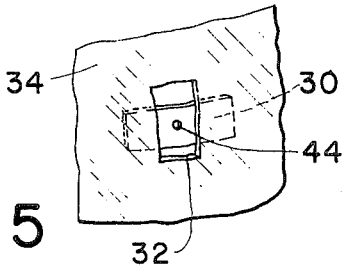
FIG. 5 illustrates a wall partially repaired employing the preferred embodiment of the present invention.
Figure 6:
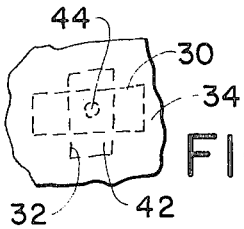
FIG. 6 illustrates a wall repaired employing the preferred embodiment of the present invention.

After the patching compound is dry the knob 16 is rotated and the self-cutting threads 15 are unthreaded from the board 30 which leaves a hole 44 in the patching compound 42 as shown in FIG. 5.

Finally, the hole 44 is filled with some patching compound and the repair is completed as shown in FIG. 5.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A device for repairing a damaged area in wall board or the like comprising:

a. a body member having a centrally disposed aperture therein;

b. a stem having self-threading means on one end slidably disposed within said aperture; and c. Pressure means adapted to cooperate with said stem and said body member.

2. A device for repairing a damaged area in wall board or the like according to claim 1, wherein said body member is a semi-circular shaped bow member.

3. A device for repairing a damaged area in wall board or the like according to claim 1, wherein said self-threading means comprises conically shaped threads.

4. A device for repairing a damaged area in wall board or the like according to claim 1, wherein said device also includes a knob affixed on said stem.

5. A device for repairing a damaged area in wall board or the like according to claim 4, wherein said knob is affixed on said stem on the end opposite said self-threading means.

6. A device for repairing a damaged area in wall board or the like according to claim 1, wherein said pressure means comprises a coil spring disposed around said stem.

7. A device for repairing a damaged area in wall board or the like according to claim 1, also including a friction washer disposed on said stem proximate to said body member in such a manner as to secure the same thereon and serves as a grip to stabilize said stem.

8. A device for repairing a damaged area in wall board or the like according to claim 4, wherein said stem, said knob, and said body member are constructed of steel.

9. A device for repairing a damaged area in wall board or the like according to claim 4, wherein said stem, said knob, and said body member are constructed of aluminum.

* * * * *